United States Patent [19]

Seo

[11] 4,243,512

[45] Jan. 6, 1981

[54] PROCESS FOR PREPARATION OF PITCH FOR PRODUCING CARBON FIBER

[75] Inventor: Ikuo Seo, Iwaki, Japan

[73] Assignee: Kureha Kagaku Kogyo Kabushiki Kaisha, Tokyo, Japan

[21] Appl. No.: 49,890

[22] Filed: Jun. 19, 1979

[30] Foreign Application Priority Data

Jun. 28, 1978 [JP] Japan ..... 53-78339

[51] Int. Cl.[3] ..... C10C 1/00

[52] U.S. Cl. ..... 208/39; 208/22; 423/447.1

[58] Field of Search ..... 208/39, 22; 423/447.1

[56] References Cited

U.S. PATENT DOCUMENTS

| | | | |
|---|---|---|---|
| 3,718,493 | 2/1973 | Joo | 208/22 |
| 3,997,654 | 12/1976 | Kölling et al. | 423/447.4 |
| 4,026,788 | 5/1977 | McHenry | 208/39 |
| 4,032,430 | 6/1977 | Lewis | 208/39 |

FOREIGN PATENT DOCUMENTS 1155448 6/1969 United Kingdom .

*Primary Examiner*—Veronica O'Keefe

*Attorney, Agent, or Firm*—Stevens, Davis, Miller & Mosher

[57] ABSTRACT

A process for preparing a pitch for carbon fiber by filtering a heavy pitch having a softening point of 150°-200° C. at a temperature of 250°-300° C. and further treating at the same temperature under reduced pressure.

2 Claims, No Drawings

PROCESS FOR PREPARATION OF PITCH FOR PRODUCING CARBON FIBER

BACKGROUND AND DETAILED DESCRIPTION OF THE INVENTION

The present invention relates to a process for preparing a pitch suitable for use in production of carbon fibers from a petroleum pitch, and more particularly it relates to a process of treating a pitch which has been heat-treated to improve its molecular weight distribution, by filtration at a temperature of 250° to 300° C. and then by holding the filtrate under reduced pressure to obtain a further treated pitch containing less than 5% by weight of a light component boiling at a temperature of lower than 500° C., substantially not containing components insoluble in nitrobenzene, having a softening point of 150° to 170° C., and suitable for spinning and infusibilization.

Carbon fibers are generally produced from melt-decomposition products of synthetic polymeric substances such as polyacrylonitrile, polyvinyl choride and polyvinyl acetate, blown alphalts and petroleum pitch. In particular, in order to produce useful carbon fibers having excellent properties from fusible carbon products such as petroleum pitch comparable with those produced from other raw materials it is necessary to increase the average molecular weight of the pitch by a suitable polycondensation of its components and in the same time to remove components infusible at its spinning temperature and volatile components of lower molecular weight. The presence of substances infusible at the temperature of spinning causes fiber break and clogging of nozzles resulting in the occurrence of unstretched fibers, which in turn brings about the deterioration of fiber quality and the reduction of spinning yield and of the rate of operation. The presence of a large amount of light components causes dirts on the nozzles resulting in the deterioration of the fiber quality and the break-down of the process of spinning. Also, such a presence of a large amount of light component is unfaborable because of the difficulty in the step of infusibilization of the fibers.

Accordingly, it is necessary to modify and reform petroleum pitch adequately in order to produce carbon fibers from the pitch. For instance, a method is disclosed in Japanese Patent Publication No. 37786/71 in which an improvement of the range of molecular weights and removal of volatile components are executed by at first removing components infusible at the temperature of spinning by filtration or centrifugation after diluting the pitch with an appropriate aromatic solvent which boils at a temperature of 200° to 400° C. and after the recovery of the solvent by distillation at a temperature of lower than 300° C., and by a heat-treating and then evaporating the light component formed in the heat-treatment.

However, the use of an aromatic solvent for the removal of the infusible components is uneconomic not only due to the complication of the steps of dissolving the pitch and of recovering the solvent but also from every point. Also the regeneration of an amount of the infusible components in the step of heat treatment for polycondensation in order to improve the range of its molecular weight is not evitable. Therefore, in the treated pitch prepared for spinning according to the Japanese Patent Publication No. 37786/1971, less than 2% by weight of components insoluble in quinoline presents in spite of the substantial removal of components insoluble in quinoline in advance, the components infusible at a temperature of spinning being represented as the components insoluble in quinoline in afore-mentioned Japanese Patent Publication No. 37786/71.

The present invention has an object of preparing a pitch containing less than 5% by weight of components boiling at a temperature of lower than about 500° C., substantially not containing components infusible at a temperature of 250° to 300° C. and having a softening point of 150° to 170° C. suitable for efficient spinning and infusibilization to make carbon fibers with excellent strength by removing components infusible at a spinning temperature without using any solvent from a pitch having a softening point of 150° to 200° C. and containing 20 to 45% by weight of components insoluble in benzene.

The pitch utilized in the present invention as a starting material is, for instance, a pitch obtained by the heat-treatment of "ethylene bottom oil". Since the conventional pitch is subjected to thermal denaturation during storage at a melt state to form components infusible at the temperature of spinning, in the process of the present invention, the pitch is filtered while maintaining the temperature of the pitch at the temperature of spinning or a little lower than it, say 250° to 300° C. Because according to the process of the present invention no solvent is used in the step of filtration, the operation is very easy. The operation of filtration is carried out in a filter providing a pitch-inlet in the upper part and a pitch-outlet in the lower part and having a rhombic across section provided with more than one filter net finer than 200 mesh in its center part (for instance, 4 nets respectively of 80, 200, 300 and 200 mesh are used in overlap), preferably, under a pressure of 0 to 2 kg/cm$^2$, at a filtering rate of 0.5–2 g/min/cm$^2$. As a result of the filtration, components infusible at the spinning temperature are removed, which process means the substantially complete removal of components which hinder a smooth spinning and are insoluble in nitrobenzene.

The pitch deprived of components insoluble in nitrobenzene and infusible components is then introduced into a reduced pressure vessel and low-boiling components and bubbles are removed from the pitch in the vessel continuously. A reduced pressure vessel is preferably provided with a pitch-inlet, an inlet for an inert gas and a suction port at the upper part and an outlet at the lower part of the vessel. The pitch is maintained at about the same temperature as that in filtration, for instance, at 280° C. in the reduced pressure vessel under a maintained pressure of 300 to 500 mmHg while introducing an inert gas, for instance, gaseous nitrogen thereinto. On the other hand, the pitch is made to flow a laminar with a thickness of 1 to 30 mm, preferably 1 to 15 mm into the vessel. The residence time of the pitch in the reduced pressure vessel is necessarily determined from the thickness of the laminar flow. The afore-mentioned removal of the low-boiling components and bubbles is executed during the period in which the pitch flows through the reduced pressure vessel. The thus treated pitch contains less than 5% by weight of low-boiling components with a boiling point of lower than 500° C. and does not naturally contain any substance with a boiling point lower than the spinning temperature. More specifically, the treated pitch contains more than 20% by weight of components insoluble in benzene and more than 80% by weight of components insoluble in n-heptane without containing a component insoluble in nitrobenzene.

In cases where conventional pitch is maintained for a long period of time at a high temperature of around 300° C. polycondensation and degradation of components thereof proceed gradually to form low-boiling components resulting in the development of bubbles which hinder the spinning. But, in the case of the pitch treated by the method of the present invention, no bubble develops even when maintained at a temperature of 300° C. for at least 20 min, and the spinning property of the pitch is excellent.

Accordingly, in cases where the pitch obtained by the above-mentioned treatment is spun within 20 min after the treatment under reduced pressure, the spinning can be continuously carried out stably for a long period of time without fiber break and dirt on the nozzles because of the absence of bubbles at the temperature of spinning.

Further, in the process of infusibilization of the spun pitch fiber, relatively mild conditions can be adopted, so that the carbon fibers obtainable from the pitch fibers of the present invention are also excellent in properties.

The following are the concrete explanation of the present invention by way of examples:

EXAMPLE 1

After maintaining the heavier pitch obtained by the heat treatment of "ethylene bottom oil" (containing 25% by weight of components insoluble in benzene and 7.4% by weight of components boiling at a temperature of 300° to 500° C. and scarcely containing components boiling at a temperature of lower than 300° C. and a component insoluble in nitrobenzene) at a temperature of 280° C. for 20 hours, the pitch was reformed into a substance containing 1% by weight of components insoluble in nitrobenzene, 6.2% by weight of components boiling at a temperature of 300° to 500° C. and 0.5% by weight of components boiling at a temperature of lower than 300° C., and having a softening point of 168° C. The pitch while maintaining at a temperature of 280° C. was filtered by a filter comprising four sheets of metal wire gauge of 80, 200, 300 and 200 mesh piled up in the above-mentioned order while applying a pressure of 2 kg/cm$^2$, at a rate of pressure-filtration of 1 g/min/cm$^2$. The filtrate was introduced into a reduced pressure vessel maintained at a temperature of 280° C. under a reduced pressure of 400 mmHg of gaseous nitrogen and was let flow naturally through the vessel in the length of 50 cm as a laminar flow of 10 to 15 mm in thickness. The thus treated pitch did not substantially contain components insoluble in nitrobenzene and also components boiling at a temperature of lower than 300° and contained 3.5% by weight of components boiling at a temperature of 300° to 500° C.

On spinning the thus obtained pitch with a centrifugal spinning machine with nozzles 0.7 mm in diameter at a spinning temperature of 280° C. and at a spinning velocity of 2000 m/min, it was excellent in spinning properties and the operation could be continued stably for as long as more than 20 hours without dirts on the nozzles and also clogging in the nozzles.

On the contrary, when the non-treated pitch (without treatment of filtration and of reduced pressure) was spun as it is with the same spinning machine, nozzle-clogging occurred after 2 hours of spinning.

EXAMPLE 2

The heavy pitch obtained by heat-treatment of "ethylene bottom oil" was used as the starting material and it was heated at a temperature of 280° C. for 40 hours and then filtered as in Example 1. The filtrate was then heated in the reduced pressure vessel under three seats of different conditions to be three different products, that is, respectively containing 3.8, 4.2 and 4.9% by weight of components boiling at a temperature of lower than 500° C. After spinning these different pitches at 280° C. with a centrifugal spinning machine, these fibers were respectively infusibilized in an infusibilizing furnace to be infusibilized carbon fibers. Each treated pitch showed a favorable spinning property, however, the pitch not treated with reduced pressure and contained 7.5% by weight of components boiling at a temperature of lower than 500° C. gave bubbles on spinning. While every one of the above-mentioned three pitch fibers gave an excellent infusibilized carbon fiber, the product obtained by infusibilization of the pitch fiber from the above-mentioned non-treated pitch was disqualified for the infusibilized carbon fiber.

What is claimed is:

1. A process for preparing a pitch suitable for use in producing carbon fibers comprising:

filtering at a temperature of 250° to 300° C. a heavy petroleum pitch, containing 20 to 45% by weight of compounds insoluble in benzene and having a softening point of 150° to 200° C., to remove fractions non-liquefying or infusible at a temperature higher than 250° to 300° C. therefrom using more than one filter net of meshes finer than 200 mesh at a rate of 0.5 to 2 g/min/cm$^2$, introducing the thus filtered pitch at a temperature of 250° to 300° C. in the form of laminar flow of 1 to 30 mm in thickness into a vessel at a reduced pressure of 300 to 500 mm Hg of an inert gas to remove volatile fractions and bubbles from said filtered pitch in the laminar flow, thereby obtaining a treated pitch containing substantially no bubbles and no components non-liquefying or infusible at a temperature of 250° to 300° C., containing less than 5% by weight of low-molecular weight fractions boiling at a temperature lower than 500° C.

2. The process according to claim 1, wherein said inert gas is gaseous nitrogen.

* * * * *